US005566873A

United States Patent [19]

Guido

[11] Patent Number: 5,566,873

[45] Date of Patent: Oct. 22, 1996

[54] DISPENSER FOR FLEXIBLE WEBBING

[75] Inventor: Joseph J. Guido, Hinsdale, Ill.

[73] Assignee: Marguerite Guido, Trustee for Joseph J. Guido, Hinsdale, Ill.

[21] Appl. No.: 167,708

[22] Filed: Dec. 15, 1993

[51] Int. Cl.[6] ..... B26F 3/02

[52] U.S. Cl. ..... 225/106; 225/34; 225/46; 225/52; 221/63; 242/594.6; 242/598.6

[58] Field of Search ..... 225/106, 1, 34, 225/39, 46, 52, 91; 206/390, 406, 554; 211/16, 115; 221/63; 242/566, 588.6, 594.5, 594.6, 598.6

[56] References Cited

U.S. PATENT DOCUMENTS

| | | | |
|---|---|---|---|
| Re. 34,019 | 8/1992 | Kuklies et al. . | |
| Re. 34,324 | 7/1993 | Haenni et al. . | |
| 441,669 | 12/1880 | Jones . | |
| 953,854 | 4/1910 | McCormack | 242/594.6 X |
| 1,122,673 | 12/1914 | Winter et al. . | |
| 2,030,602 | 2/1936 | McDonough et al. . | |
| 2,182,605 | 12/1939 | Wolfert | 242/594.6 |
| 3,002,668 | 10/1961 | Castelli . | |
| 3,269,593 | 8/1966 | Lodewick et al. . | |
| 3,771,700 | 11/1973 | Garr . | |
| 3,774,838 | 11/1973 | Christie . | |
| 3,868,052 | 2/1975 | Rockefeller . | |
| 3,958,768 | 5/1976 | Fairbanks . | |
| 3,982,659 | 9/1976 | Ross . | |
| 3,986,479 | 10/1976 | Bonk . | |
| 3,994,417 | 11/1976 | Boedecker . | |
| 4,165,832 | 8/1979 | Kuklies et al. . | |
| 4,179,055 | 12/1979 | Milner | 225/106 X |
| 4,181,218 | 1/1980 | Cox . | |
| 4,191,307 | 3/1980 | LeClaire, Jr. et al. . | |
| 4,239,164 | 12/1980 | Barnsbee et al. | 225/52 X |
| 4,289,262 | 9/1981 | Finkelstein . | |
| 4,526,291 | 7/1985 | Margulies . | |
| 4,535,912 | 8/1985 | Bonk . | |
| 4,648,530 | 3/1987 | Granger . | |
| 4,793,539 | 12/1988 | Haenni et al. . | |
| 4,930,385 | 6/1990 | Wilfong, Jr. et al. . | |
| 5,024,349 | 6/1991 | Haenni et al. . | |
| 5,135,134 | 8/1992 | Dancy . | |
| 5,209,371 | 5/1993 | Daniels . | |

FOREIGN PATENT DOCUMENTS

| | | |
|---|---|---|
| 1107603 | 4/1975 | Japan . |
| 1325923 | 8/1973 | United Kingdom . |

*Primary Examiner*—Rinaldi I. Rada
*Assistant Examiner*—Clark F. Dexter
*Attorney, Agent, or Firm*—Fitch, Even, Tabin & Flannery

[57] ABSTRACT

A dispenser for flexible webbing includes a dispensing nozzle formed by generally parallel wires bent along tortuous paths. The wires are spaced apart to provide a dispensing opening through which the webbing passes. The wires of the dispensing nozzle frictionally engage the webbing to limit the amount of webbing withdrawn, and to support the webbing during a tearing operation.

24 Claims, 8 Drawing Sheets

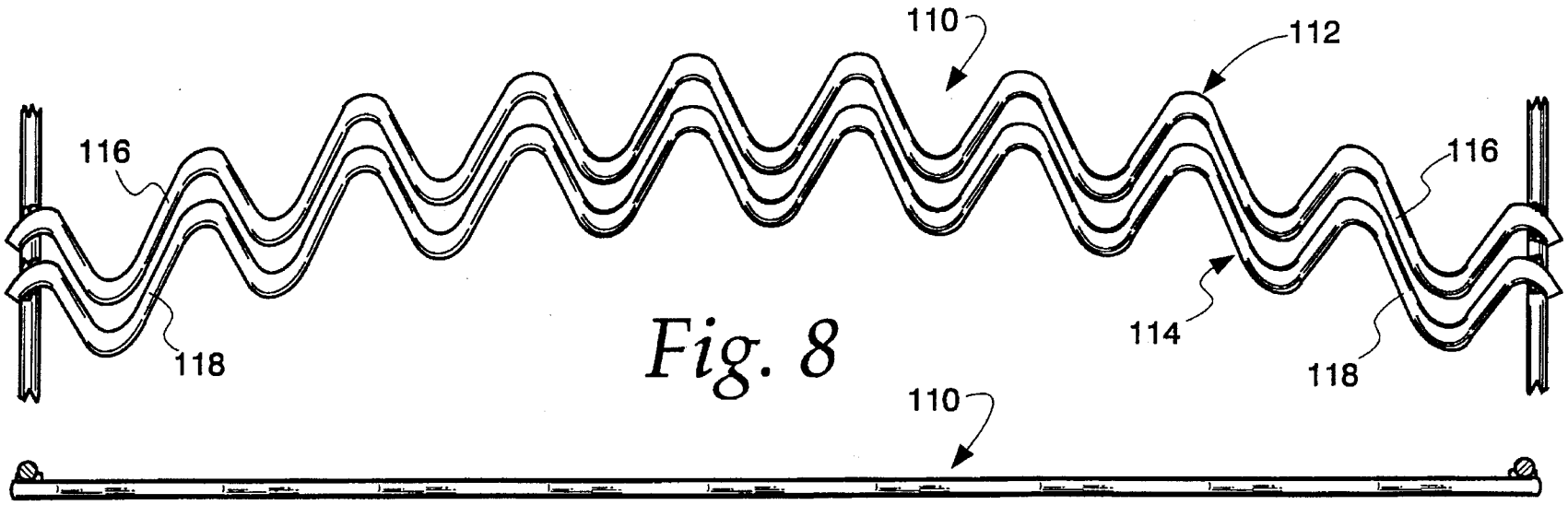
Fig. 8
Fig. 9
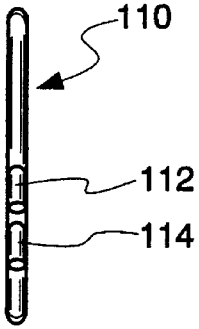
Fig. 10

DISPENSER FOR FLEXIBLE WEBBING

BACKGROUND OF THE INVENTION

1. Field of the Invention

The present invention pertains to dispensers for storing and dispensing flexible webbing, and in particular to webbing having portions joined to one another along lines of weakness.

2. Description of the Related Art

It has been found commercially advantageous to provide products formed from flexible webbing and to transport the articles as a continuous webbing in either a roll or fan-fold form. Notable examples include paper towels and plastic bags. A dispenser for paper towels is shown in U.S. Pat. No. 2,030,602 for holding a roll of paper towels within a wire frame, and for supporting the roll as individual towels are torn therefrom.

U.S. Pat. Nos. 5,135,134; 5,024,349 and Reissue Pat. No. 34,324 disclose a variety of dispensers for rolls of plastic bags. The dispensers, in general, include an arrangement for supporting a roll of bags, and an opening through which the bags may be withdrawn and which support the roll of bags as an individual bag is torn therefrom.

U.S. Pat. No. 5,209,371 is directed to a wire frame dispenser for storing and dispensing T-shirt style merchandise bags, bags which have protruding loops at their upper end which serve as convenient handles. These types of bags are growing increasingly popular, especially in supermarkets and food merchandising concerns. In these types of environment, bags are dispensed by store personnel who are familiar with the particular dispenser equipment in use. However, it is becoming increasingly popular to provide plastic bags to be dispensed on demand by consumers, at various points in a commercial establishment. For example, plastic bags have been provided at produce sections for use by consumers when selecting product they wish to purchase. It is important in these instances, especially that the dispenser be easy to use and uncomplicated, even for consumers who may not be mechanically skilled, and the dispensers must provide reliable operation to prevent consumer dissatisfaction. One concern has been the reliable severing of bags along lines of weakness formed in a continuous webbing. It is important that the bags tear completely with each operation and that the free end of the webbing be immediately available for the next consumer.

SUMMARY OF THE INVENTION

It is an object according to the principles of the present invention to provide a dispenser for flexible webbing, and to support the webbing during a dispensing operation.

Another object according to the principles of the present invention is to provide a dispenser of the above-described type for webbing having a serial array of products joined together along lines of weakness, and so as to support the webbing as portions are torn therefrom.

A considerable amount of consumer experience in tearing flexible webbing has been gained in the use of wax paper, tin foil, and plastic wrap products, for example. Consumers are used to pulling a free end of the webbing in a path of least resistance until a desired length is withdrawn, and then pulling on the free end of the webbing with an angular deflection so as to tear off the portion extracted. It is an object according to the principles of the present invention to build upon this consumer experience to provide a dispenser whose operation is intuitively obvious, even for consumers not mechanically skilled who may be distracted at the moment with other concerns.

BRIEF DESCRIPTION OF THE DRAWINGS

FIG. 8 is a fragmentary front elevational view of another embodiment of a dispensing nozzle illustrating principles according to the present invention;

FIG. 9 is a top plan view thereof;

FIG. 10 is a side view thereof;

DETAILED DESCRIPTION OF THE PREFERRED EMBODIMENTS

Figure 1:
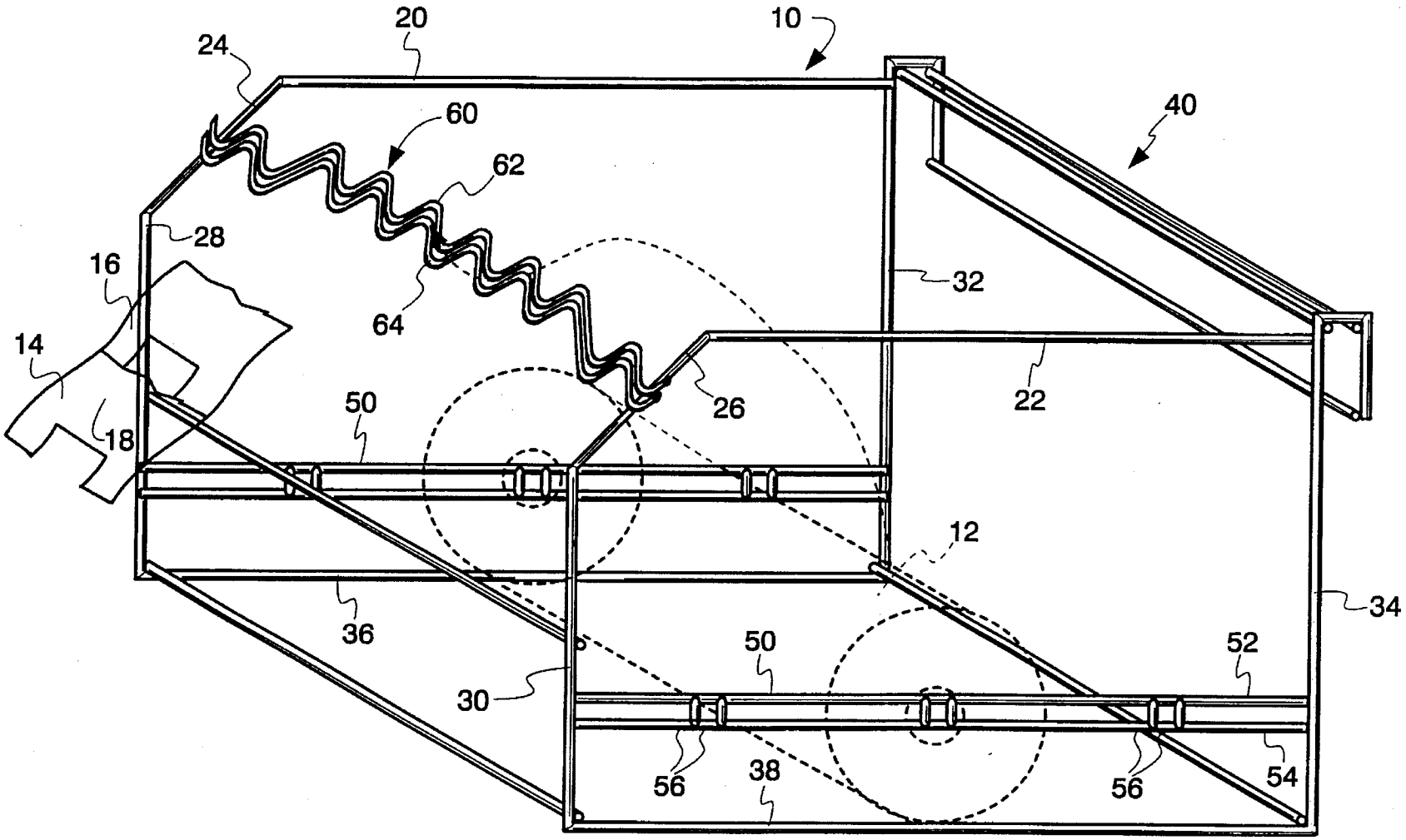
FIG. 1 is a perspective view of a dispenser illustrating the principles of the present invention.

Referring now to the drawings, and initially to FIGS. 1–4, a dispenser is generally indicated at 10. The dispenser 10 holds a roll of flexible webbing 12 drawn in phantom. A portion of the webbing, torn from roll 12 is illustrated in FIG. 1 as containing serially adjacent portions 14, 16 joined together along a line of weakness 18. Dispenser 10 is preferably made of wire frame construction, with closed loop end walls 20, 22 having bevelled portions 24, 26, front portions 28, 30, rear portions 32, 34, and bottom portions 36, 38, respectively. A wire hanger of generally L-shaped configuration generally indicated at 40 extends from the back of the frame. Other configurations of the hanger are possible. For example, the hanger could be formed of flat stock material and need not have an L-shaped cross-sectional configuration.

Webbing support members 50 are secured to the sidewalls 20, 22, and include three positions for holding webbing. As will be seen herein, dispenser 10 can be made to accommodate multiple rolls of webbing at a single time. In the preferred embodiment illustrated in FIG. 1, ports 50 comprise a pair of generally parallel wires 52, 54 divided into three window portions by transverse wires 56.

Figure 2:
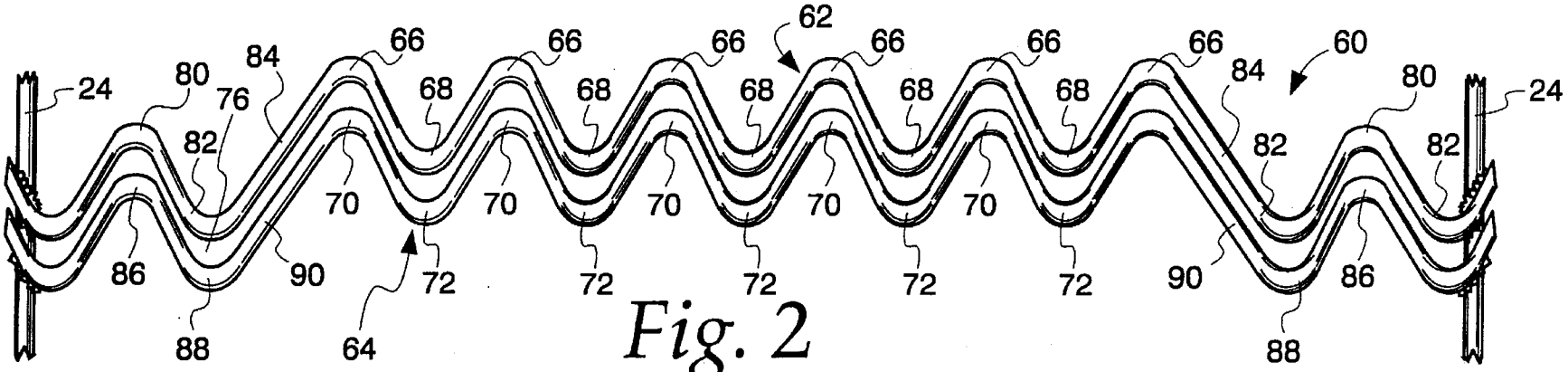
FIG. 2 is a fragmentary front elevational view thereof, taken on an enlarged scale.
Figure 3:
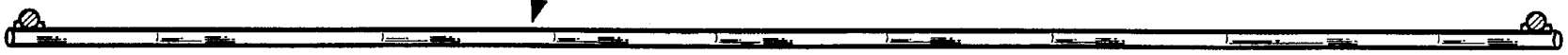
FIG. 3 is a top plan view of the fragment of FIG. 2.
Figure 4:
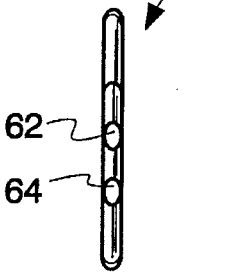
FIG. 4 is a side elevational view thereof.

Referring to FIGS. 1–4, dispenser 10 further includes a dispensing nozzle 60 comprising a pair of bent wires 62, 64. The wires 62, 64 of the preferred embodiment are substantially identical to one another and are bent to form a plurality of round-cornered, generally triangular teeth 66, 68, respectively. The teeth 66, 68 are formed in medial portions of wires 62, 64 and the tips of these teeth preferably lie along respective, generally parallel straight lines. Referring to FIG. 2, the teeth 68 extend in a downward direction whereas the teeth 66 extend in an opposed, upward direction. As can be seen in FIGS. 3 and 4, the wires 62, 64 lie in the same plane, with the teeth extending in opposite directions in that common plane.

The wires 62, 64 include a medial section disposed between end sections with a plurality of nested teeth formed in the medial sections. In the preferred embodiment of FIG. 2, the teeth are of a generally triangular, round-cornered configuration, and are dimensioned and positioned so as to be nested within one another. Wire 62, for example, has upwardly extending teeth 66 lying along a common straight line, and downwardly extending teeth 68 also lying along a straight, preferably parallel line. Wire 64 is similarly formed, with upwardly extending teeth 70 and downwardly extending teeth 72, aligned along respective, preferably parallel lines. As can be seen in FIG. 2, the wires 62, 64 are spaced apart from one another so as to form a gap 76 therebetween.

In the preferred embodiment illustrated in FIG. 2, the gap 76 is generally constant throughout its length, that is between the ends of wires 62, 64. As will appreciated by those skilled in the art, gap 76 need not be held constant, but could vary from one end of the wires to the other. As can be seen in FIGS. 3 and 4, the wires 62, 64 of the preferred embodiment are both confined to a common plane. Although the wires could be bent out of that common plane if desired so as to stagger the teeth formed along the wires. The wire 62 has upwardly extending teeth 80 and downwardly extending teeth 82. As can be seen, the downwardly extending tooth 82 is joined to its adjacent upwardly extending tooth 66 by an elongated wire section 84. Wire 64 is formed in a similar fashion, with upwardly and downwardly extending end section teeth 86, 88. Elongated wire sections 90 join teeth 70, 88 together and, as with the elongated wire section 84, displaces the end section teeth from the medial teeth 66, 68. Preferably, the end section teeth 80 lie on a common line generally parallel to the line joining teeth 68, and preferably also parallel to the line joining teeth 66. The same pattern is also present in wire 64.

The elongated wires 84, 90 provide a convenient point for threading a flexible webbing through gap 76. It has been found expedient to insert a corner at one edge of the webbing through the gap between the elongated wires, and feeding the free edge of the webbing through the undulating, serpentine portion of gap 76 formed between the medial teeth. As those skilled in the art will appreciate, the remaining free corner of the webbing is oftentimes difficult to feed through a dispensing nozzle. However, with the present invention, elongated parallel wires 84, 90 are provided to ease the insertion of the remaining corner. In use, the webbing, when inserted through dispensing nozzle 60, follows the serpentine, tortuous path of gap 76, with the teeth of wire 62, 64 frictionally engaging the webbing. The frictional engagement is found to be superior from that of prior art dispensing nozzles and provides a heretofore unattainable reliable tearing of plastic bags from a continuous roll, even when the webbing is pulled in a direction generally perpendicular to the plane of the dispensing nozzle, i.e., the path of least resistance. It is generally preferred, however, that users impart an angular tearing motion away from a direction perpendicular to the nozzle plane. For example, it is generally preferred that the users pull the webbing toward either wire frame portion 20 or 22, that is, in a sideways direction. As mentioned above, users familiar with wax paper, tinfoil, plastic wrap and the like will intuitively pull the webbing in a downward direction, putting increased force on teeth 70, thus greatly increasing the pullout friction while supporting the webbing for a transverse tearing motion.

Figure 5:
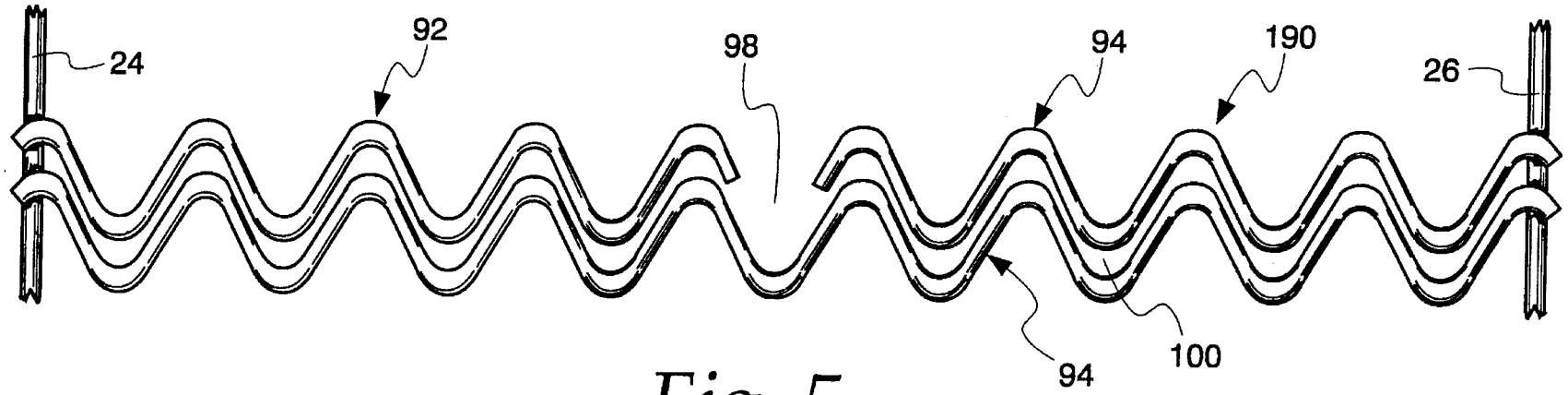
FIG. 5 is a fragmentary front elevational view of an alternative embodiment of a dispensing nozzle according to the principles of the present invention.
Figure 6:
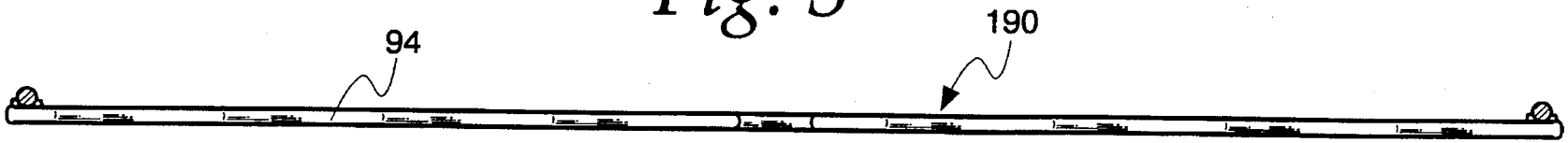
FIG. 6 is a top plan view thereof.
Figure 7:
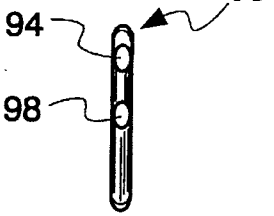
FIG. 7 is an end view thereof.

Referring now to FIGS. 5–7, an alternative embodiment of a dispensing nozzle is generally indicated at 190. Nozzle 190 comprises three wires bent in an undulating or serpentine configuration, preferably that of a triangular zig-zag pattern. Shortened wires 92, 94 are located to one side of a common, neighboring wire 96, preferably extending along the entire length of both wires 92, 94. As mentioned, the wires 92, 94 and 96 are bent to form triangular teeth, again preferably triangular teeth having rounded corners. Wires 92, 94 are spaced apart to form a gap 98 at a medial portion of nozzle 190. The optional gap 98 is provided to assist in inserting a flexible webbing into a nozzle opening 100 formed between the wires 92, 94 and 96. The gap 98 between wires 92, 94 is preferably dimensioned small enough so that the nozzle opening or gap 100 functions as a continuously defined gap from the viewpoint of dispensing operations. The gap 98 could be omitted if desired by joining wires 92, 94 together. In the preferred embodiment, the wire 92 is identical to a portion of wire 96 and is nested therewith. The same is true of wire 94, which is also nested with the right-hand portion of the lower wire 96. As can be seen in FIGS. 6 and 7, the nozzle opening 100 is preferably arranged in a common plane, although the teeth of the wires 92, 94 and 96 could be bent out of the plane if desired.

Referring now to FIGS. 8–10, another embodiment of a dispensing nozzle is generally indicated at 110. Dispensing nozzle 110 comprises continuous wires 112, 114 which are substantially identical to the aforedescribed wire 96, except for being bent in an arc, so that the teeth of the wires extend along smooth curved, nested arcs. In the preferred embodiment illustrated in FIG. 8, elongated wire portions 116, 118 are provided, but could be omitted if desired.

Figure 11:
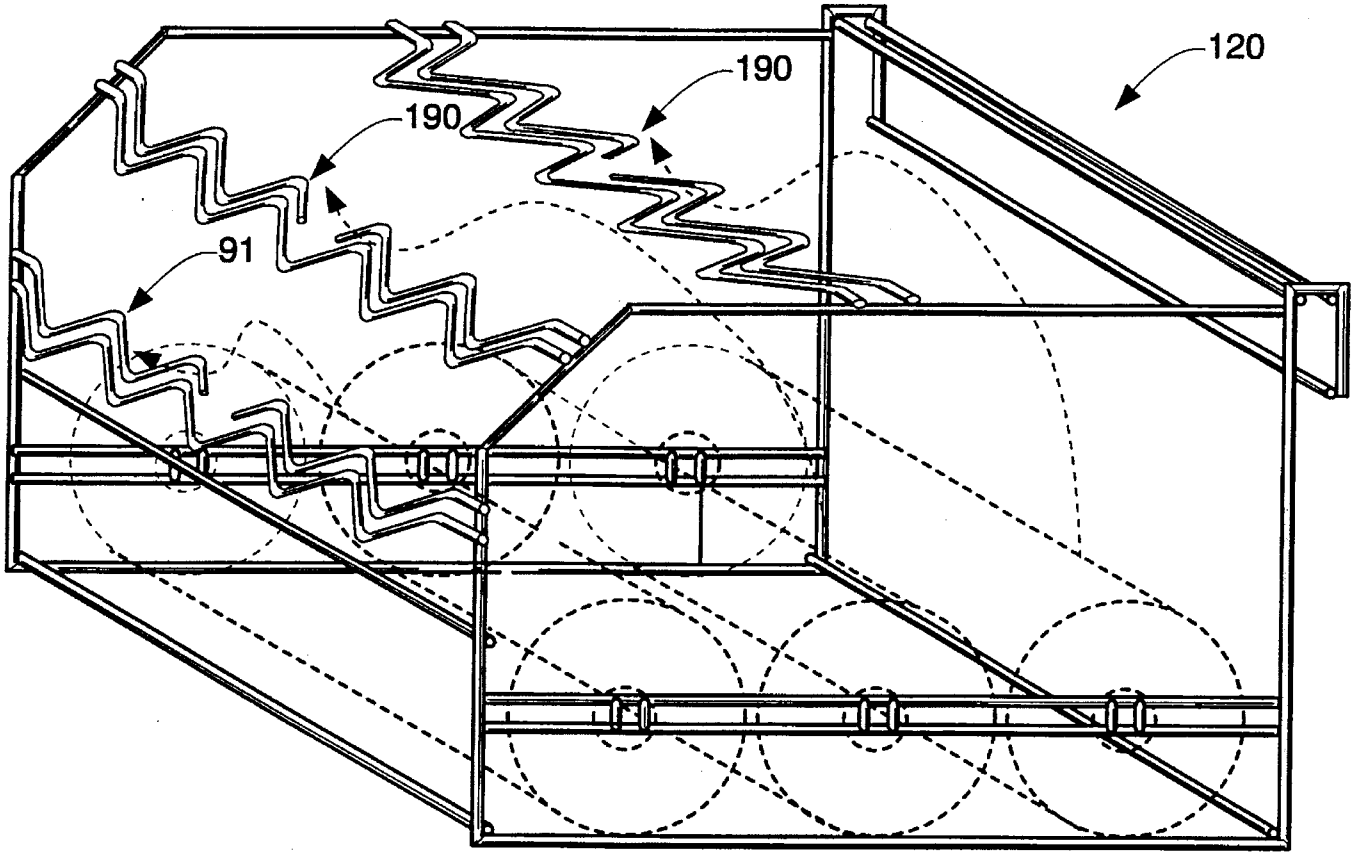
FIG. 11 is a perspective view of an alternative dispenser according to principles of the present invention.

Referring now to FIG. 11, an alternative embodiment of a dispenser is generally indicted at 120. The supporting framework of dispenser 120 is substantially identical to that described above for dispenser 10. However, the nozzle 60 of dispenser 10 has been replaced with three nozzles arranged in horizontal, beveled and vertical planes. Two of the nozzles comprise the nozzle 190 described above with reference to FIGS. 5–7. The third nozzle is generally indicated at 91 and is identical to nozzle 190 except that the gap 98 has been omitted.

Figure 12:
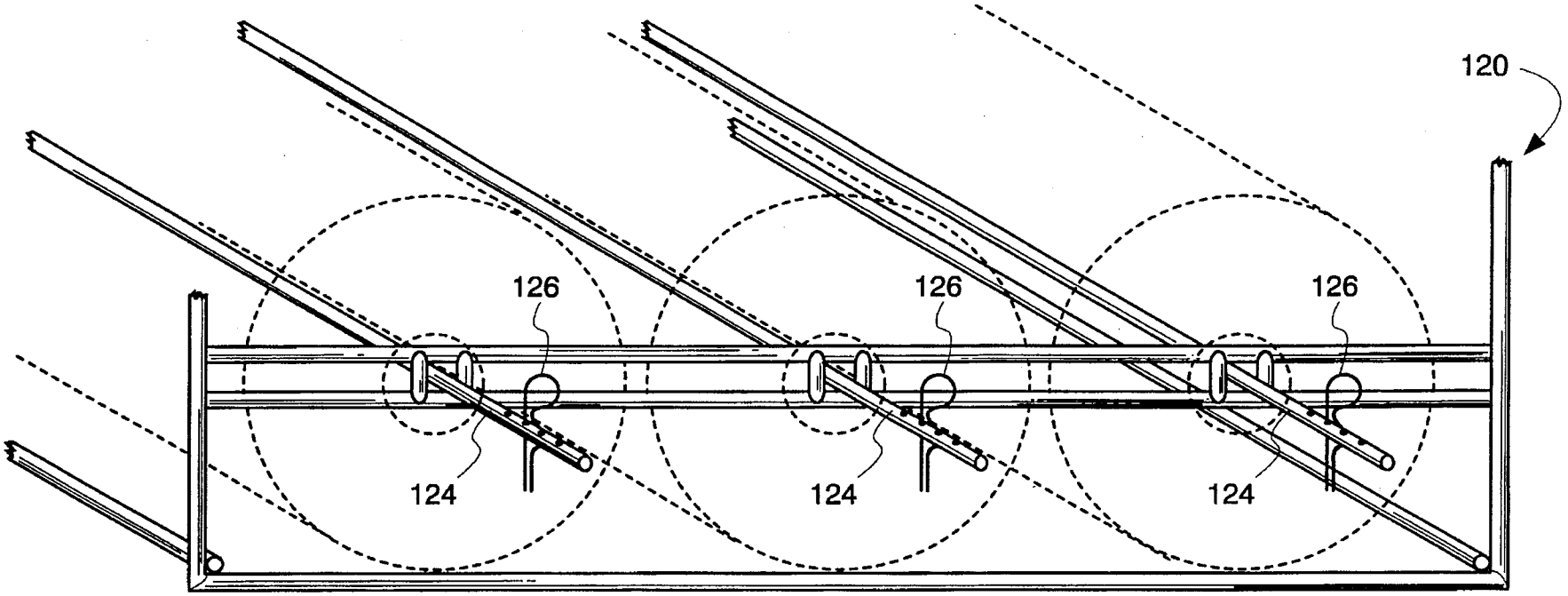
FIG. 12 is a fragmentary perspective view thereof, taken on an enlarged scale.

Referring now to FIG. 12, the dispenser 120 is shown slightly enlarged, to illustrate supporting axles 124, each having a plurality of apertures at their end portions for receiving a hitch pin 126. Arrangement of FIG. 12 allows the dispenser to accommodate rolls of varying widths.

Figure 14:
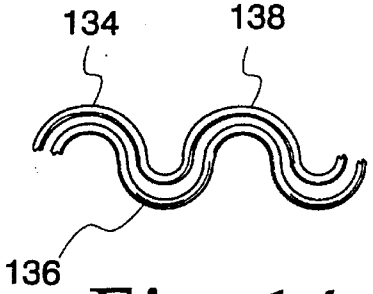
FIG. 14 is a fragmentary front elevational view thereof.
Figure 13:
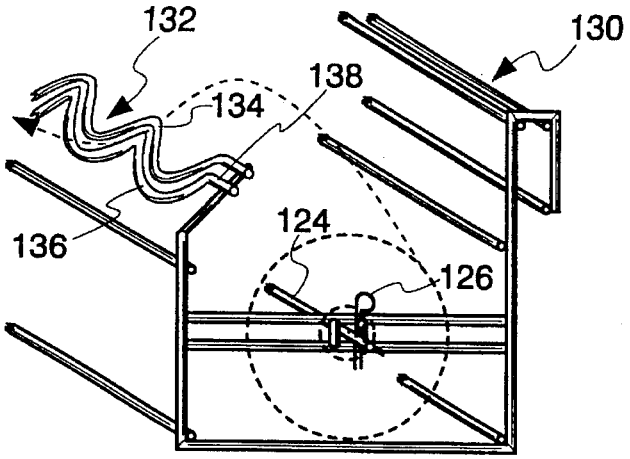
FIG. 13 is a fragmentary perspective view of a further alternative embodiment of a dispenser illustrating principles of the present invention.
Figure 17:
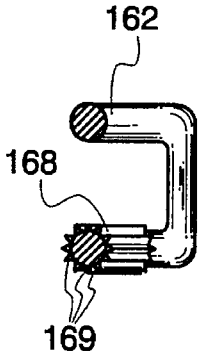
FIG. 17 is a fragmentary perspective shown partly in cross section, taken along line 17—17 of FIG. 16.

Turning now to FIGS. 13 and 14, an alternative embodiment of a dispenser is generally indicated at 130. Dispenser 130 has a single supporting axle 124 and a nozzle 132.

Nozzle 132, as can be seen in FIG. 14, is formed from a pair of wires 134, 136, which are bent in a series of nontriangular, smoothly curved undulations to form a tortuous path 138, therebetween. A preferred embodiment illustrated in FIG. 14, the wires 134, 136 are bent in a generally sinusoidal pattern, and are regularly formed, i.e., with constant periodicity and amplitude from end to end.

Figure 15:
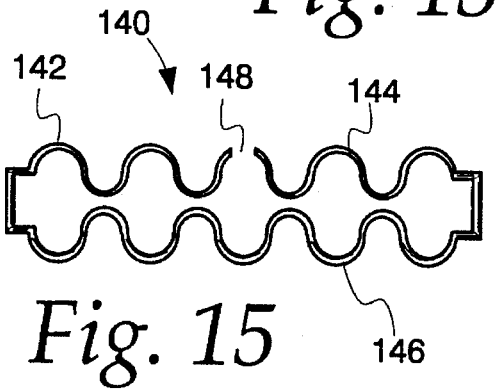
FIG. 15 is a fragmentary front elevational view of an alternative embodiment of a dispensing nozzle according to the principles of the present invention.

Turning now to FIG. 15, an alternative embodiment of a nozzle is generally indicated at 140, formed from three wires 142, 144 and 146. The wires 142, 144 are spaced apart at a medial portion of nozzle 140 so as to form a gap 148. The wire 146 is preferably identical to the wire 136 described above with reference to FIG. 13, and wires 142, 144 are preferably formed from a wire identical to wire 136, but having the gap 148 formed in the medial portion thereof. Unlike the preceding embodiments, the wires 142, 144 and 146 are not nested. Thus, a plurality of discrete frictional engagement points are formed by nozzle 140.

Figure 16:
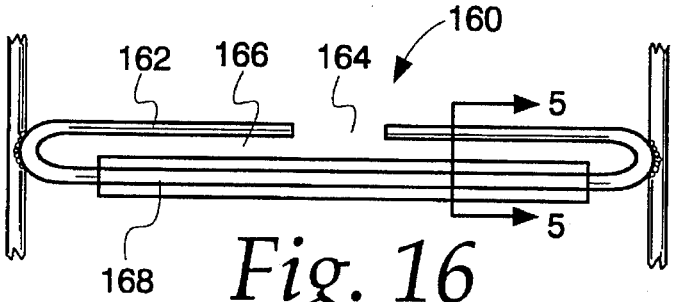
FIG. 16 is a fragmentary front elevational view of yet another alternative embodiment of a dispensing nozzle according to the principles of the present invention.

Turning now to FIG. 16, an alternative embodiment of a dispensing nozzle is generally indicated at 160. Nozzle 160 is preferably formed from a continuous wire 162 bent in a modified oval or "racetrack" configuration. Wire 162, as shown in FIG. 16, is dimensioned to have a gap 164 formed in the medial portion of nozzle 160. The gap 164, however, can be omitted if desired. The webbing opening or gap 166 is preferably formed by bending a continuous wire 162. Frictional engagement with webbing being dispensed is provided by a splined portion 168. The teeth 169 of splined portion 168 frictionally engage webbing being passed through opening 166. Greatly increased friction is provided as the webbing is pulled in a downward direction. In addition to other advantages of improved frictional engagement and webbing support, nozzle 160 can be dimensioned so that gap 166 provides generally unhindered withdrawal of the roll when the webbing is pulled in an upward direction, to permit rapid dispensing. It is generally preferred, however, that the gap 166 be formed so as to frictionally engage the torn end of a webbing to prevent threading of the webbing when an end portion is torn therefrom.

Figure 18:
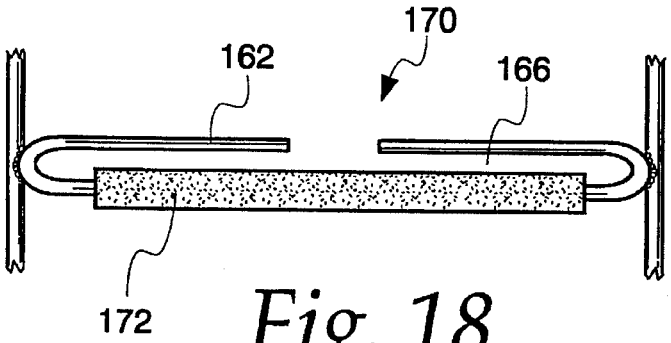
FIG. 18 is a fragmentary front elevational view of a dispensing nozzle according to principles of the present invention.

Turning now to FIG. 18, an alternative embodiment of a nozzle is generally indicated at 170. Nozzle 170 is generally identical to the nozzle 160 described above, except that the splined portion 168 is replaced by a soft rubber coating 172. Materials other than soft rubber could be used, if desired, to provide sufficient frictional engagement with the webbing being withdrawn through nozzle opening or gap 166.

Figure 19:
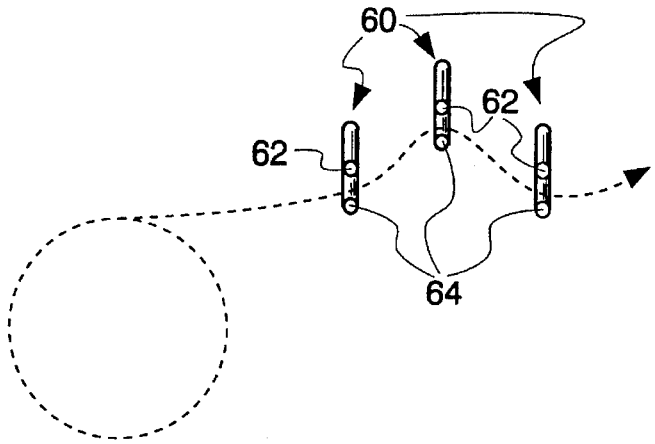
FIG. 19 is a fragmentary side elevational view of an alternative dispenser illustrating principles according to the present invention.
Figure 20:
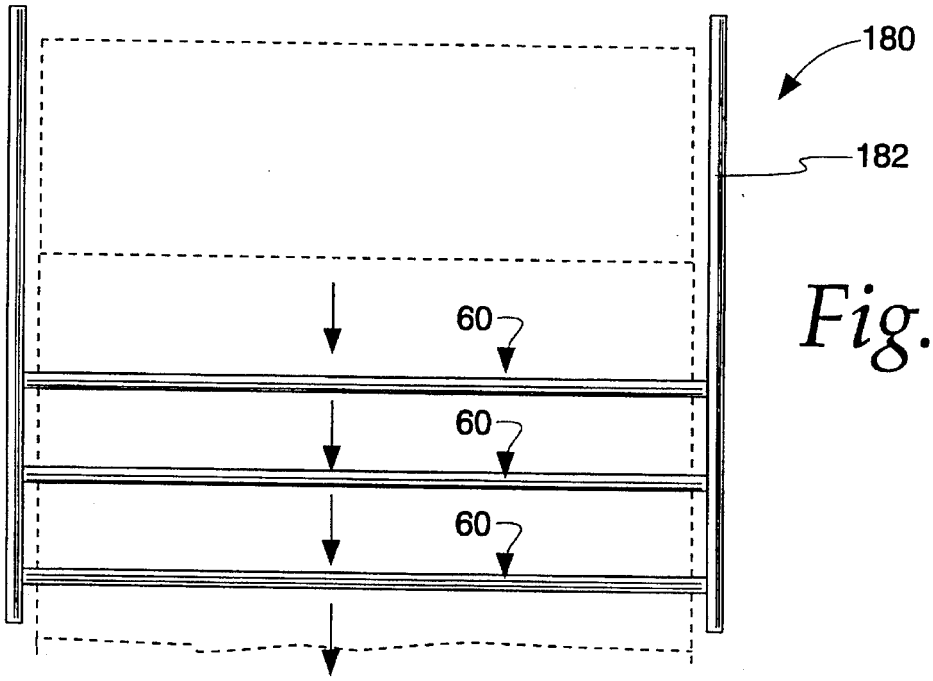
FIG. 20 is a top plan view thereof.
Figure 21:
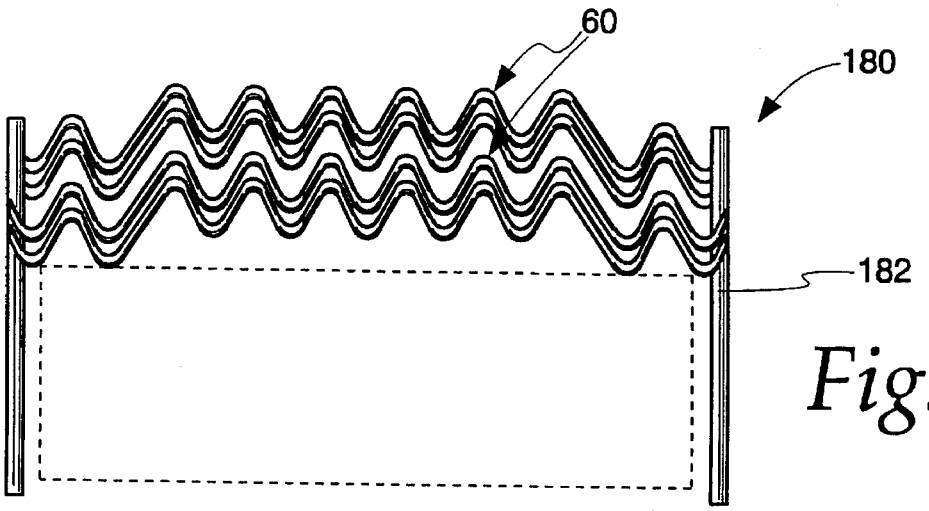
FIG. 21 is a front elevational view thereof.

Turning now to FIGS. 19–21, an alternative embodiment of a dispenser is generally indicated at 180. The dispenser 180 includes a supporting frame 182 which is preferably constructed the same as the supporting frame described above in FIG. 1. Dispenser 180 employs a plurality of nozzles 60 for a single webbing. As can be seen in FIG. 19, for example, the nozzles 60 are displaced from one another so as to cause the webbing to follow a tortuous, undulating path.

The present invention has found immediate application for dispensing T-shirt style bags joined end-to-end. However, the present invention can be used with flexible webbing of virtually any type, including continuous sheets (folded length-wise or unfolded) and assemblies of layers of sheets. The present invention is directed to webbing provided in roll or fan-fold form.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A dispenser for flexible webbing having a free end and comprising a serial array of product units joined end to end along lines of weakness, the dispenser comprising:

a frame;

means for supporting the flexible webbing as the free end is withdrawn from the frame;

a dispensing nozzle supported by the frame, for guiding the webbing and for supporting the webbing as product units are severed by tearing along lines of weakness, including a pair of generally coextensive wires spaced apart to form a gap through which the webbing passes, at least one of the wires including friction means for frictionally engaging the webbing; and said wires are spaced apart from one another in a first direction, each said wire being double-ended and having a medial section disposed between end sections, the medial section including a plurality of medial teeth which extend in the first direction, and said end sections contain at least one tooth spaced from said medial teeth in the first direction, said friction means being formed at least in part by said plurality of medial teeth.

2. The dispenser of claim 1 wherein said teeth of said first and said second wires are nested so that the spacing between the wires is generally constant along the length of the wires.

3. The dispenser of claim 1 wherein said teeth of said end sections are joined to the teeth of said medial section by elongated wire sections.

4. The dispenser of claim 1 wherein said teeth of said first and said second wires are generally triangular.

5. A dispenser for flexible webbing having a free end and comprising a serial array of product units joined end to end along lines of weakness, the dispenser comprising:

a frame;

means for supporting the flexible webbing as the free end is withdrawn from the frame;

a dispensing nozzle supported by the frame, for guiding the webbing and for supporting the webbing as product units are severed by tearing along lines of weakness, including a pair of generally coextensive wires spaced apart to form a gap through which the webbing passes, at least one of the wires including friction means for frictionally engaging the webbing; and said friction means comprises the wires being elongated and having an undulating pattern along their length so as to engage the webbing at a plurality of spaced apart points.

6. The dispenser of claim 5 wherein said wires define a plurality of generally triangular teeth.

7. The dispenser of claim 5 wherein said wires define a plurality of teeth which are disposed generally along a straight line.

8. The dispenser of claim 6 wherein said wires define a plurality of teeth which are disposed generally along an arc.

9. The dispenser of claim 5 wherein said wires define a plurality of generally rounded teeth.

10. A dispenser for flexible webbing having a free end and comprising a serial array of product units joined end to end along lines of weakness, the dispenser comprising:

a frame;

means for supporting the flexible webbing as the free end is withdrawn from the frame; and a dispensing nozzle supported by the frame, for guiding the webbing and for supporting the webbing as product units are severed by tearing along lines of weakness, including a pair of generally coextensive wires spaced apart in a first direction to form a gap through which the webbing passes, each said wire being double-ended and having a medial section disposed between end sections, the medial section including a plurality of medial teeth which extend in the first direction, and said end sections contain at least one tooth spaced from said medial teeth in the first direction.

11. The dispenser of claim 10 wherein said teeth of said first and said second wires are nested so that the spacing between the wires is generally constant along the length of the wires.

12. The dispenser of claim 10 wherein said teeth of said end sections are joined to the teeth of said medial section by elongated wire sections.

13. The dispenser of claim 10 wherein said teeth of said first and said second wires are generally triangular.

14. The dispenser of claim 10 wherein said medial teeth are disposed generally along a straight line.

15. The dispenser of claim 10 wherein said medial teeth are disposed generally along an arc.

16. The dispenser of claim 10 wherein said wires are generally planar, with said medial teeth disposed generally along a straight line lying in the plane, the teeth of said end section lying along a line generally parallel to said straight line.

17. A dispenser for flexible webbing having a free end and comprising a serial array of product units joined end to end along lines of weakness, the dispenser comprising:

a frame;

means for supporting the flexible webbing as the free end is withdrawn from the frame; and a dispensing nozzle supported by the frame, for guiding the webbing and for supporting the webbing as product units are severed by tearing along lines of weakness, including a pair of generally coextensive wires spaced apart to form a nozzle opening through which the webbing passes, the wires being elongated and having an undulating pattern along their length so as to engage the webbing at a plurality of spaced apart points.

18. The dispenser of claim 17 wherein said nozzle is double ended, and defines enlarged openings at each end.

19. The dispenser of claim 17 wherein the wires have generally straight line longitudinal centerlines.

20. The dispenser of claim 19 wherein the wires contain portions which are generally parallel to each other.

21. The dispenser of claim 20 wherein the wires have a sawtooth pattern.

22. The dispenser of claim 17 further comprising at least a second dispensing nozzle supported by the frame so as to be spaced from said one nozzle, said nozzles lying in respective nonparallel planes.

23. The dispenser of claim 17 wherein said nozzle further includes a third wire which is coextensive with one of said pair of coextensive wires, and wherein said wires extend in a lateral direction of the nozzle and cooperate to define said nozzle opening which is formed in a first direction between two of said coextensive wires and a gap which is formed between the ends of two of said wires in said lateral direction.

24. A dispenser for flexible webbing having a free end and comprising a serial array of product units joined end to end along lines of weakness, the dispenser comprising:

a frame;

means for supporting the flexible webbing as the free end is withdrawn from the frame; and at least three dispensing nozzles supported by the frame, for guiding the webbing and for supporting the webbing as product units are severed by tearing along lines of weakness, each dispensing nozzle including a pair of generally coextensive wires spaced apart to form a nozzle opening through which the webbing passes, the wires being elongated and having an undulating pattern along their length so as to engage the webbing at a plurality of spaced apart points, said dispensing nozzles lying in three separate and generally parallel planes.

* * * * *

UNITED STATES PATENT AND TRADEMARK OFFICE

CERTIFICATE OF CORRECTION

PATENT NO. : 5,566,873

DATED : October 22, 1996

INVENTOR(S) : Joseph J. Guido

It is certified that error appears in the above-indentified patent and that said Letters Patent is hereby corrected as shown below:

Column 6, line 60, change the dependency from "6" to --5--.

Signed and Sealed this

Fourth Day of March, 1997

Bruce Lehman

*Attest:*

BRUCE LEHMAN

*Attesting Officer*

*Commissioner of Patents and Trademarks*